US007516728B1

(12) United States Patent
Staley et al.

(10) Patent No.: US 7,516,728 B1
(45) Date of Patent: Apr. 14, 2009

(54) WINDAGE TRAY

(75) Inventors: David R. Staley, Flushing, MI (US); Alan W. Hayman, Romeo, MI (US); Jeremy T. Demarest, Waterford, MI (US); James J. Mazzola, III, Dryden, MI (US); Frederick J. Rozario, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/930,944

(22) Filed: Oct. 31, 2007

(51) Int. Cl.
*F02B 77/00* (2006.01)

(52) U.S. Cl. ..... 123/195 C

(58) Field of Classification Search ..... 123/196 R, 123/195 A, 198 DA, 198 E, 195 C
See application file for complete search history.

(56) References Cited

U.S. PATENT DOCUMENTS 4,911,118 A * 3/1990 Kageyama et al. ..... 123/195 H
5,479,886 A * 1/1996 Leonard et al. ..... 123/196 R
5,829,406 A 11/1998 Mazzola et al.
6,019,071 A * 2/2000 Maciejka, Jr. ..... 123/41.35
6,729,292 B1 * 5/2004 Bock et al. ..... 123/195 C
6,742,481 B2 * 6/2004 Baldwin ..... 123/41.35
6,874,460 B2 * 4/2005 Duwel ..... 123/196 R
6,941,923 B2 * 9/2005 Saito ..... 123/196 R
7,204,223 B2 * 4/2007 Kajiwara et al. ..... 123/195 H
2005/0279316 A1 12/2005 Rice et al.

* cited by examiner

*Primary Examiner*—Hai H Huynh

(57) ABSTRACT

A windage tray apparatus is provided and is configured to be mountable within a crankcase at least partially defined by an engine block of an internal combustion engine. The crankcase has a first bay and a non-adjacent second bay. The internal combustion engine has a crankshaft rotatably supported within the crankcase. The windage tray includes a tray member and a passage at least partially defined by said tray member and in communication with the first bay and the non-adjacent second bay. The passage is operable to allow gas transfer between the first bay and the non-adjacent second bay to reduce the motoring friction of the internal combustion engine. An internal combustion engine incorporating the disclosed windage tray apparatus is also provided.

17 Claims, 5 Drawing Sheets

WINDAGE TRAY

TECHNICAL FIELD

The present invention relates to a windage tray for an internal combustion engine.

BACKGROUND OF THE INVENTION

An oil pan is typically disposed beneath an engine block and crankshaft of an internal combustion engine, and is configured to receive oil that drains or is otherwise exhausted from the engine block, valvetrain, crankshaft, and/or main bearings that support the crankshaft. The oil collects in a sump of the oil pan and is then pumped from a sump pick-up location into a lubrication system associated with the internal combustion engine.

The rotation of the crankshaft and the reciprocal motion of pistons will cause gases to move within the crankcase, the volume within which the crankshaft is housed, causing turbulence. These turbulent gases may be referred to as "windage." During operation of the internal combustion engine, some oil that would otherwise drain into the oil pan may instead become entrained in the gases. Accordingly, some vehicle engines include an oil deflector, also referred to as a "windage tray" to separate the crankshaft from the oil pan in order to reduce or eliminate the effects of crankshaft rotation on oil stored or collected in the oil pan. The oil deflector operates to remove oil from the gasses and prevent the entrainment of oil by the gases, which allows the oil to drain back to the sump and be recirculated through the engine's lubrication system. Additionally, the operating efficiency of the internal combustion engine may be reduced due to the inefficient transfer of gases within the crankcase as a result of the pumping action associated with the reciprocal motion of pistons within the internal combustion engine. This gas transfer characteristic is referred to as "bay-to-bay breathing". The transfer of gases between volumes or bays of the crankcase is often impeded by structural obstructions such as bulkheads, main bearing caps, etc.

SUMMARY OF THE INVENTION

A windage tray apparatus is provided and is configured to be mountable within a crankcase at least partially defined by an engine block of an internal combustion engine. The crankcase has a first bay and a non-adjacent second bay, i.e. at least a third bay disposed between the first and the second bay. The internal combustion engine has a crankshaft rotatably supported within the crankcase. The windage tray includes a tray member and a passage at least partially defined by said tray member and in communication with the first bay and the non-adjacent second bay. The passage is operable to substantially allow gas transfer between the first bay and the non-adjacent second bay to reduce the motoring friction of the internal combustion engine. An internal combustion engine incorporating the claimed windage tray is also disclosed.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
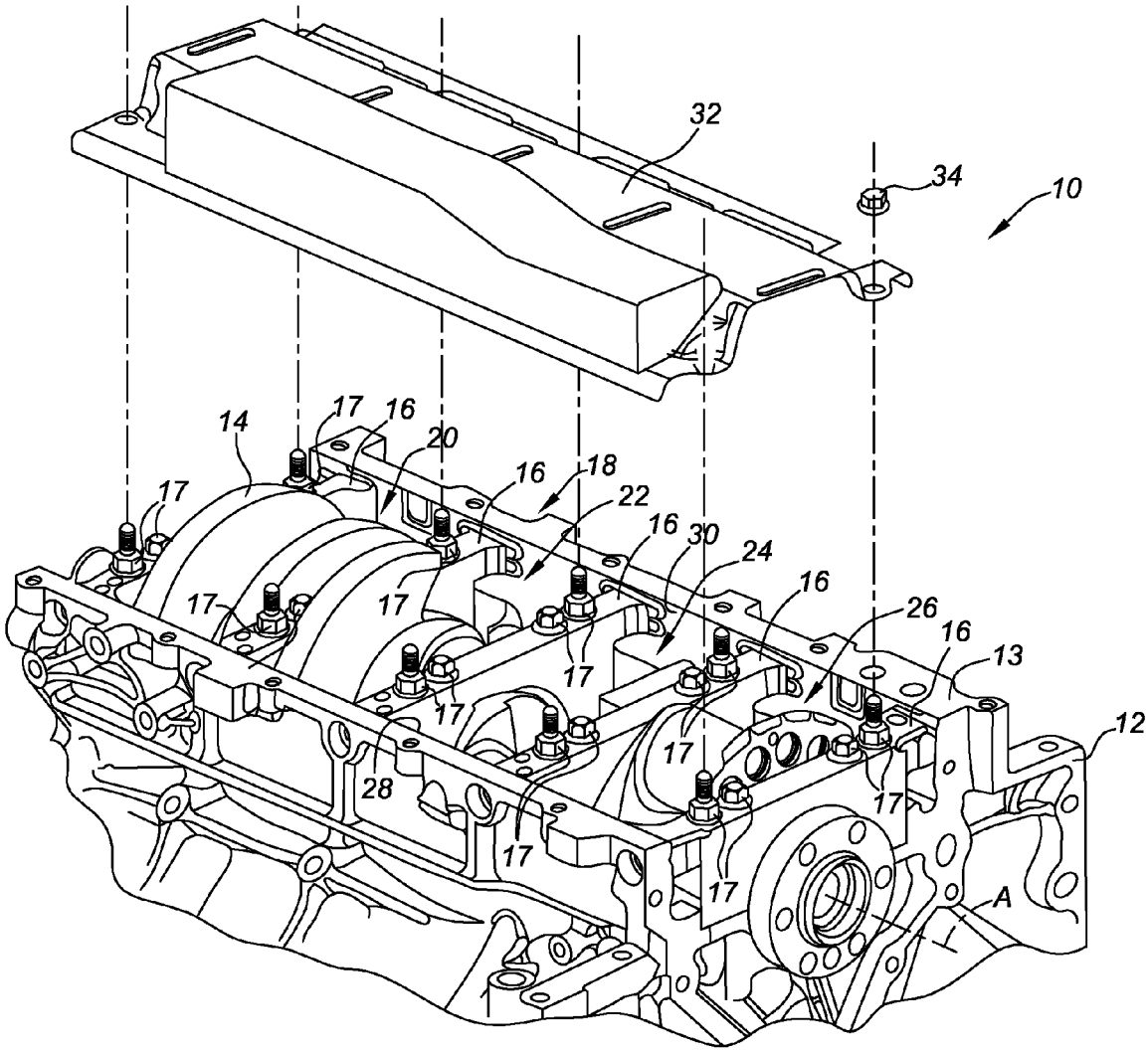
FIG. 1 is a exploded perspective view of the underside of an internal combustion engine having a windage tray mountable within a crankcase having a first second, third, and fourth bay.

Referring to the drawings wherein like reference numbers correspond to like or similar components throughout the several views, there is shown in FIG. 1 a portion of an internal combustion engine, generally indicated at 10. The internal combustion engine 10 of FIG. 1 is an eight cylinder, V-type engine. The internal combustion engine 10 includes an engine block 12 preferably formed from cast metal such as, for example, aluminum, iron, magnesium, etc. The engine block 12 has a mounting surface 13 adapted to mount an oil pan, not shown, to the internal combustion engine 10. The engine block 12 rotatably supports a crankshaft 14. The crankshaft 14 is retained with respect to the engine block 12 by a plurality of main bearing caps 16 and rotates about an axis of rotation, indicated at A. The main bearing caps 16 are mounted to the engine block 12 by fasteners 17. The crankshaft 14 operates to convert the reciprocal motion of pistons, not shown, into rotational motion.

The engine block 12 at least partially defines a crankcase 18. The crankcase 18 includes a first bay 20, corresponding to a first and second cylinder (both not shown), a second bay 22, corresponding to a third and fourth cylinder (both not shown), a third bay 24, corresponding to a fifth and sixth cylinder (both not shown), and a fourth bay 26, corresponding to a seventh and eighth cylinder (both not shown). The engine block 12 is characterized as having a "deep skirt" design such that skirt portions 28 and 30 depend or extend from the engine block 12 and cooperate with the main bearing caps 16 to partially define the first, second, third, and fourth bay 20, 22, 24, and 26. The first, second, third, and fourth bay 20, 22, 24, and 26 each vary in volume with the operation of the internal combustion engine 10 and contain an amount of gas therein.

A windage tray 32 is configured to mount within the crankcase 18 of the internal combustion engine 10. The windage tray 32 is preferably positioned between the crankshaft 14 and the oil pan of the internal combustion engine 10 and is operable to reduce oil entrainment of the windage or turbulent gases within the crankcase 18 during operation of the internal combustion engine 10. The windage tray 32 is preferably formed from a stamped metal, such as steel or aluminum. A plurality of nuts 34, one of which is shown in FIG. 1, cooperate with the fasteners 17 to mount the windage tray 32 within the crankcase 18. The method of mounting the windage tray 32 via the fasteners 17 and nuts 34 will be discussed in greater detail herein below with reference to FIG. 5. The various aspects of the windage tray 32 will be discussed in greater detail hereinbelow with reference to FIGS. 3 and 4.

An exemplary firing order, i.e. the order in which a fuel and air mixture contained within the cylinders is ignited to effect or initiate the expansion stroke of the respective piston, for the internal combustion engine 10 is 1-8-4-3-6-5-7-2 (following the cylinder numbering convention wherein one bank of the eight cylinder engine includes the odd numbered cylinders in ascending order, while the opposite bank includes the even numbered cylinders in ascending order). As such, the relative displaced volume within the first, second, third, and fourth bays 20, 22, 24, and 26 as a result of the reciprocal motion of the pistons may be mapped with respect to the rotational angle of the crankshaft 14 as shown in graph 36 of FIG. 2.

Figure 2:
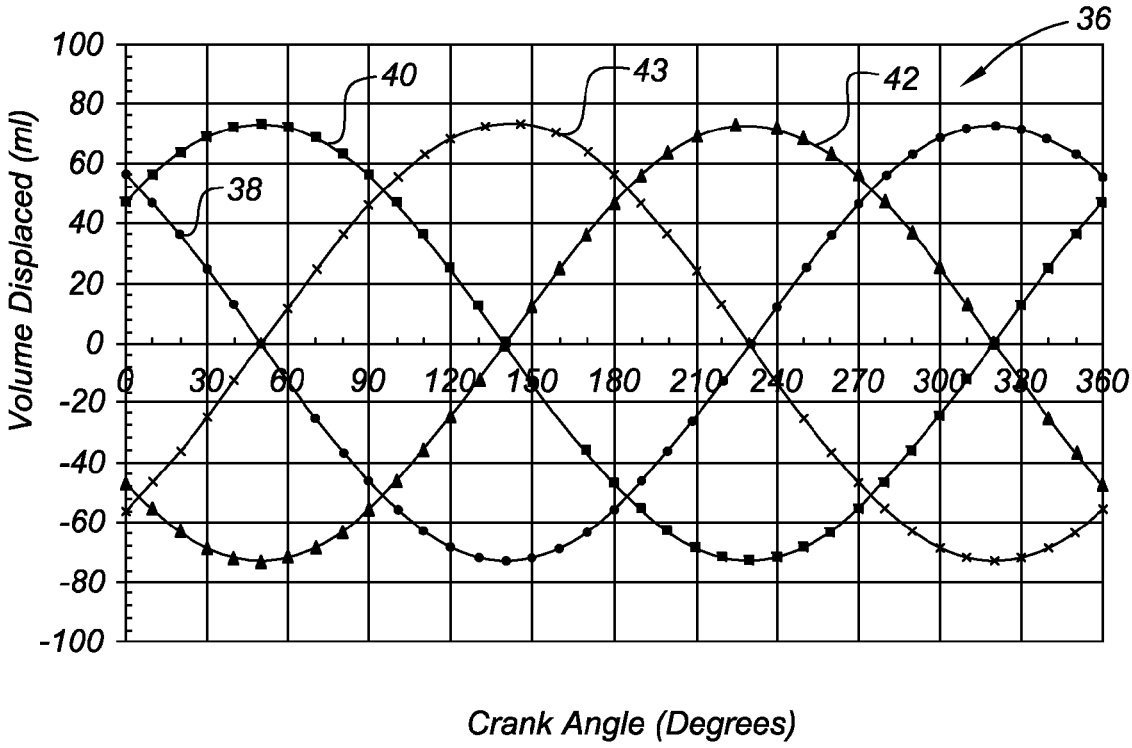
FIG. 2 is a graph illustrating displaced volume versus crank angle for each of the first, second, third, and fourth bay of FIG. 1.

Referring to FIG. 2, the graph 36 illustrates the displaced volumes of the first, second, third, and fourth bays 20, 22, 24, and 26 with respect to crank angle for an exemplary eight cylinder, V-type internal combustion engine having 4.7 liters of displacement. Curve 38 illustrates the volume displaced of the first bay 20 during operation of the internal combustion engine 10. Positive values for displaced volumes indicate the volume of the first bay 20 is greater than the equilibrium value, i.e. zero displaced volume. Alternatively, negative values for displaced volumes indicate the volume of the first bay 20 is less than the equilibrium value. A similar convention will apply to curve 40, corresponding to the second bay 22, curve 42, corresponding to the third bay 24, and curve 43, corresponding to the fourth bay 26. As illustrated in FIG. 2 by curves 38 and 43 the respective volumes of the first and fourth bay 20 and 26 are oppositely and alternately displaced. Similarly, curves 40 and 42 illustrate that the respective volumes of the second and third bay 22 and 24 are oppositely and alternately displaced. Since the second and third bays 22 and 24 are substantially adjacent to each other, displaced gases may alternately pass from the second bay 22 to the third bay 24 and from the third bay 24 to the second bay 22 to balance the flow of gases and reduce any pressure rise within one of the second bay 22 and the third bay 24, thereby reducing motoring frictional losses within the internal combustion engine 10. However, the first bay 20 and the fourth bay 26 are substantially non adjacent to one another, i.e. are separated by the second and third bays 22 and 24, as illustrated in FIG. 1; therefore, the path that the gases must traverse to balance the flow of gases and reduce any pressure rise within one of the first and fourth bays 20 and 26 may be tortuous or circuitous resulting in an increase in motoring frictional losses and a decrease in the operating efficiency of the internal combustion engine 10. This transfer of gas between bays during operation of the internal combustion engine 10 is termed bay-to-bay breathing.

Figure 3:
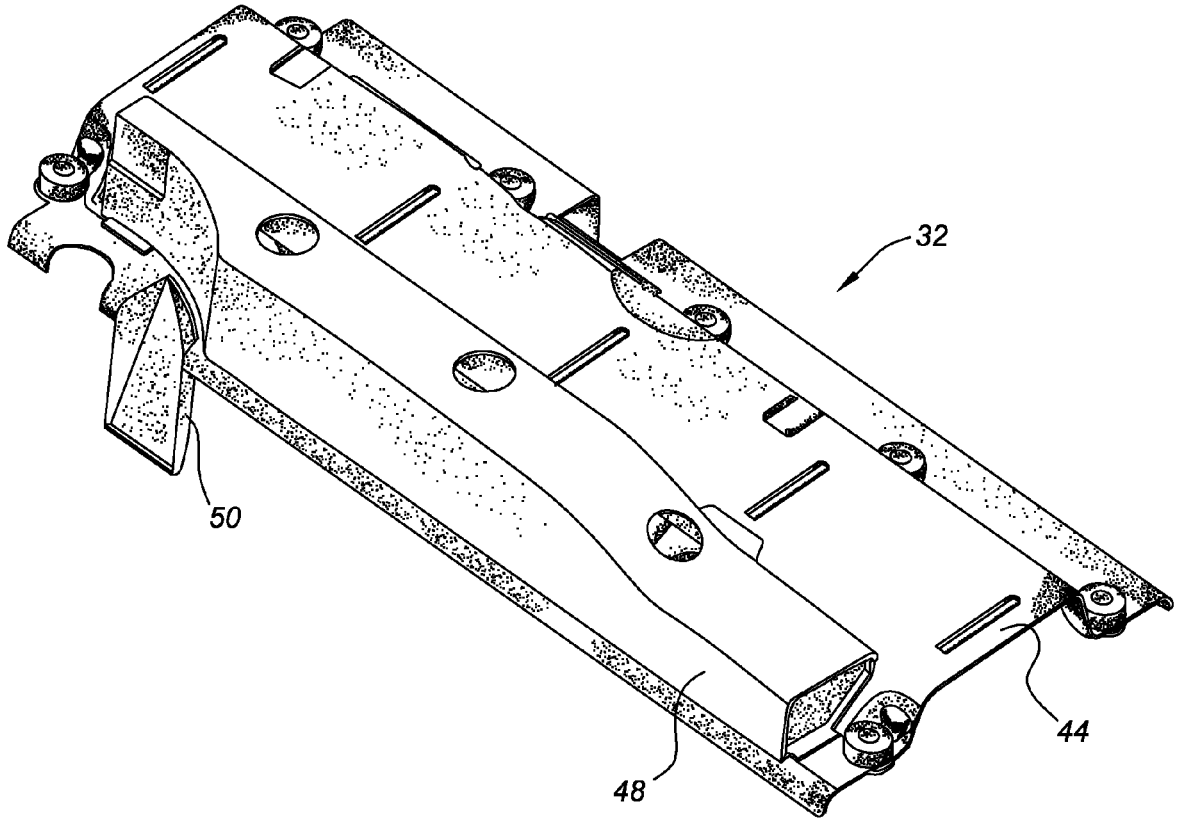
FIG. 3 is a perspective view of the underside of the windage tray of FIG. 1.

Referring now to FIG. 3 and with continued reference to FIG. 1, there is shown the windage tray 32 of FIG. 1 further illustrating the aspects of the preferred embodiment. The windage tray 32 includes a tray member 44 at least partially defining a passage 46, shown in FIG. 4. The passage 46 extends substantially the length of the tray member 44 and is in communication with the first and fourth bays 20 and 26. The passage 46 is operable to promote gas exchange of transfer between the first and fourth bays 20 and 26 as a result of the volumetric changes of the first and fourth bays 20 and 26 during operation of the internal combustion engine 10 (see FIG. 2). The passage 46 is preferably formed from a channel member 48 formed from sheet metal and attached or mounted to the tray member 44. The channel member 48 may be formed from steel, stainless steel, aluminum, etc. and may be affixed to the tray member 44 using known fastening means, such as welding, bonding, mechanical fastening etc.

Figure 4:
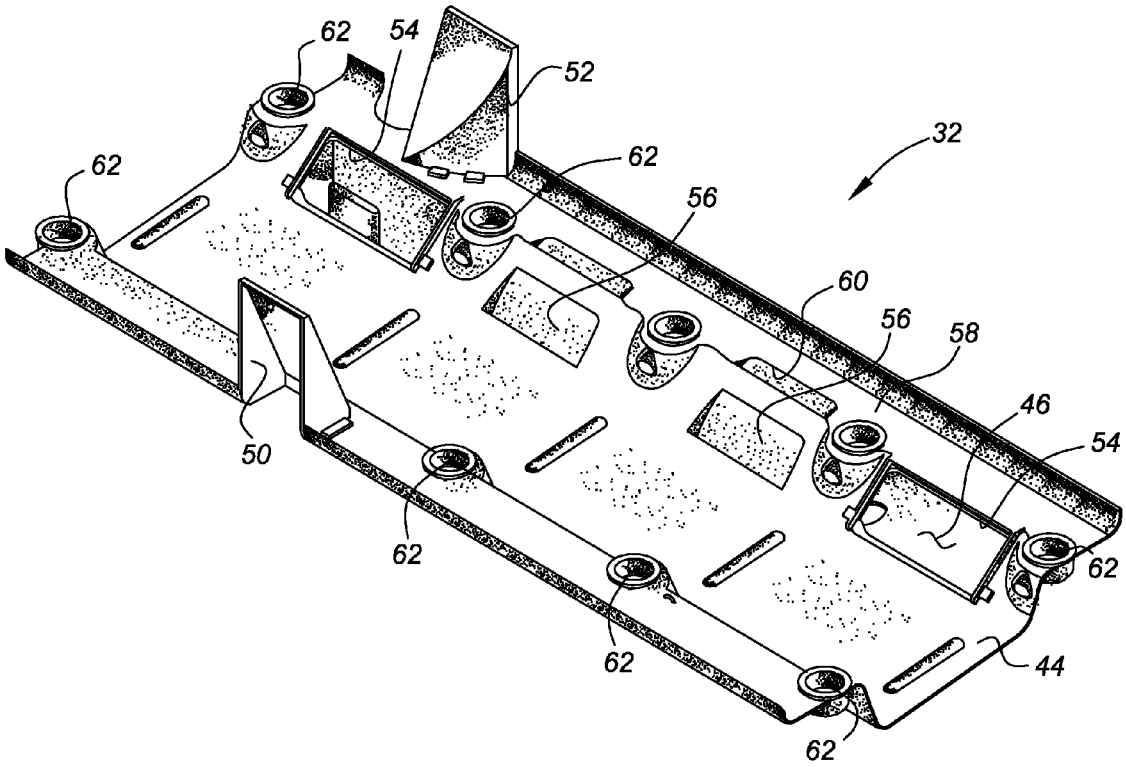
FIG. 4 is a perspective view of the topside of the windage tray of FIG. 1.

Shields 50 and 52, shown in FIG. 4, depend or extend from the tray member 44 and are configured to engage a respective skirt portion 28 and 30 of the engine block 12. The shields 50 and 52 are operable to direct oil draining from the cylinder heads, not shown, and the engine block 12 away from the rotating crankshaft 14 thereby reducing or preventing oil from being entrained by the gases within the crankcase 18. The shields 50 and 52 may be formed integrally with the tray member 44 or may be formed separately and attached using known fastening techniques.

Referring to FIG. 4 and with continued reference to FIGS. 1 and 3, there is shown a perspective view of the topside, i.e. the side adjacent to the crankshaft 14, of the windage tray 32 of FIG. 3. Windows or orifices 54 are defined by the tray member 44 and are operable to provide communication between the first and fourth bays 20 and 26 and the passage 46. The tray member 44 defines a plurality of louvers or slots 56 operable to promote the drain back of oil being thrown from the rotating crankshaft 14. The slots 56 preferably extend longitudinally along the tray member 44 generally parallel to the axis of rotation A of the crankshaft 14. A scraper 58 is mounted to the tray member 44 such that the scraper 58 is positioned substantially adjacent to the crankshaft 14 when the windage tray 32 is mounted to the internal combustion engine 10. The scraper 58 has a contoured profile 60 to approximate the rotational profile of the crankshaft 14. The scraper 58 is operable to strip or remove oil from the rotating crankshaft 14 during operation of the internal combustion engine 10, thereby reducing the likelihood of oil entrainment within the windage.

A plurality of recesses 62 are defined by the tray member 44 and are operable to substantially enclose at least a portion of the fasteners 17 thereby allowing the windage tray 32 to fit closer to the crankshaft 14 when mounted to the internal combustion engine 10. The method of mounting the windage tray 32 with respect to the internal combustion engine 10 will be discussed in greater detail hereinbelow with reference to FIG. 5.

Figure 5:
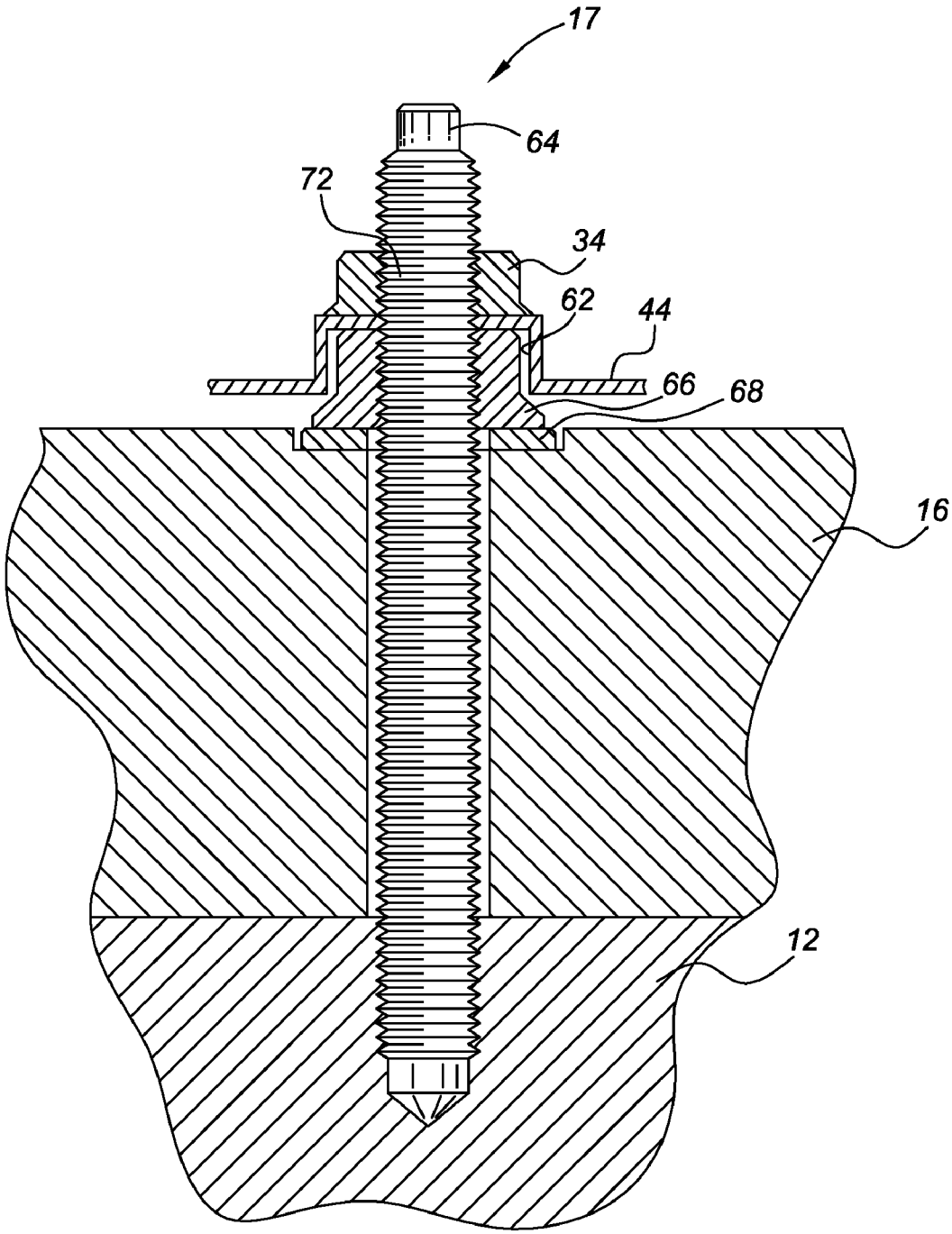
FIG. 5 is a cross sectional view of a portion of the windage tray of FIGS. 2 and 3 illustrating a method of mounting the windage tray.

Referring now to FIG. 5, there is shown a sectional view of a portion of the internal combustion engine 10 of FIG. 1 illustrating a fastening method consistent with the preferred embodiment. The fastener 17 includes a threaded stud 64 operable to threadingly engage the engine block 12. A nut 66 threadingly engages the stud 64 and cooperates with a washer 68 to retain the main bearing cap 16 with respect to the engine block 12. The recess 62 defined by the tray member 44 is configured to receive at least a portion of the nut 66 therein such that the tray member 44 is compactly mounted with respect to the crankshaft 14, shown in FIG. 1. The nut 34 threadingly engages a threaded portion 72 of the stud 64 that extends from nut 66. The nut 34 is operable to retain the tray member 44 with respect to the internal combustion engine 10. The stud 64 and nut 66 may be formed integrally or separate, as shown in FIG. 5 while remaining within the scope of that which is claimed.

By reducing the flow restriction between the first bay 20 and the fourth bay 26 of the crankcase 18 via the passage 46, the crankcase fluid pumping losses of the internal combustion engine 10 may be reduced, thereby improving the high speed power output of the internal combustion engine 10. Additionally, the windage tray 32 is operable to reduce the oil entrainment within the gases thereby further reducing frictional losses within the internal combustion engine 10. As a result of reduced frictional losses, the windage tray 32 may lower bulk oil temperatures at high engine speed and full load operating conditions. Furthermore, the windage tray 32 is effective in reducing the oil aeration thereby improving the effectiveness of the lubrication system of the internal combustion engine 10 at high engine speeds under part and full load operating conditions.

The discussion hereinabove have focused mainly on the bay-to-bay breathing characteristics of an eight cylinder v-type internal combustion engine: however, those skilled in the art will recognize that the claimed windage tray may be incorporating within alternate engine architectures, such as six cylinder v-type and inline engines, while remaining within the scope of that which is claimed. While the best modes for carrying out the invention have been described in detail, those familiar with the art to which this invention relates will recognize various alternative designs and embodiments for practicing the invention within the scope of the appended claims.

The invention claimed is:

1. A windage tray mountable within a crankcase defined by an engine block of an internal combustion engine and having a first bay and a second bay with at least a third bay disposed between the first and second bay, each having a variable volume containing gas, the internal combustion engine having a crankshaft with a rotational profile and being rotatably supported within the crankcase, the windage tray comprising:

a tray member;

wherein said tray member at least partially defines a passage in communication with the first bay and the non-adjacent second bay; and wherein said passage is operable to allow gas transfer between the first bay and the second bay to reduce the crankcase fluid pumping losses of the internal combustion engine.

2. The windage tray of claim 1, wherein said tray member defines a plurality of longitudinally extending slots operable to promote oil drain back within the crankcase.

3. The windage tray of claim 1, further comprising at least one shield operatively connected to said tray member and operable to engage the engine block to direct oil draining from said engine block substantially away from said crankshaft.

4. The windage tray of claim 1, further comprising:

a scraper operatively connected to said tray member; and wherein said scraper is positioned substantially adjacent to the crankshaft when the windage tray is mounted within the crankcase to strip oil from the crankshaft.

5. The windage tray of claim 4, wherein said scraper is contoured to approximate the rotational profile of the crankshaft.

6. The windage tray of claim 1, wherein said tray member defines a first orifice operable to enable communication between the first bay and said passage and wherein said tray member defines a second orifice operable to enable communication between the second bay and said passage.

7. An internal combustion engine comprising:

an engine block partially defining a crankcase having a first bay and a second bay with at least a third bay between said first and second bays each containing a gas;

a windage tray mounted within said crankcase;

wherein said windage tray at least partially defines a passage;

wherein said passage is in communication with said first bay and said second bay; and wherein said passage is operable to enable gas transfer between said first bay and said second bay to reduce the motoring friction of the internal combustion engine.

8. The internal combustion engine of claim 7, further comprising:

a crankshaft rotatably supported within said crankcase by said engine bock;

a scraper operatively connected to said windage tray and positioned substantially adjacent to said crankshaft; and wherein said scraper is operable to strip oil from said crankshaft.

9. The internal combustion engine of claim 8, wherein said scraper is contoured to approximate the rotational profile of said crankshaft.

10. The internal combustion engine of claim 7, wherein said windage tray defines a plurality of slots extending longitudinally along said tray member and parallel to the axis of rotation of said crankshaft and operable to promote oil drain back within the crankcase.

11. The internal combustion engine of claim 7, further comprising:

at least one shield operatively connected to said windage tray and operable to engage the engine block to direct oil draining from said engine block substantially away from said crankshaft.

12. The internal combustion engine of claim 7, wherein said windage tray defines a first orifice operable to enable communication between said first bay and said passage and wherein said windage tray defines a second orifice operable to enable communication between said second bay and said passage.

13. The internal combustion engine of claim 7, further comprising:

at least one main cap operable to retain said crankshaft with respect to said engine bock;

at least one fastener operable to retain said at least one main cap with respect to said engine block; and wherein said at least one fastener is operable to mount said windage tray within said crankcase.

14. The internal combustion engine of claim 13, wherein said at least one fastener includes a stud having a threaded portion engagable by a nut and wherein said windage tray defines a recess operable to substantially receive at least a portion of said nut.

15. A windage tray mountable within a crankcase defined by an engine block of an internal combustion engine and having a first bay and a fourth bay separated by a second and third bay, wherein the first, second, third, and fourth bay each contain a variable volume of gas, the internal combustion engine having a crankshaft with a rotational profile and being rotatably supported within the crankcase and the internal combustion engine having an eight cylinder configuration, the windage tray comprising:

a tray member;

wherein said tray member defines a plurality of slots operable to promote oil drain back within the crankcase;

a scraper operatively connected to said tray member;

wherein said scraper is positioned substantially adjacent to the crankshaft when the windage tray is mounted within the crankcase to strip oil from the crankshaft;

wherein said tray member at least partially defines a passage in communication with the first bay and the fourth bay; and wherein said passage is operable to allow gas transfer between the first bay and the fourth bay to reduce the motoring friction of the internal combustion engine.

16. The windage tray of claim 15, wherein said scraper is contoured to approximate the rotational profile of the crankshaft.

17. The windage tray of claim 15, wherein said tray member defines a first orifice operable to enable communication between the first bay and said passage and wherein said tray member defines a second orifice operable to enable communication between the fourth bay and said passage.

* * * * *